United States Patent [19]

Jackson et al.

[11] 4,399,877

[45] Aug. 23, 1983

[54] CONTINUOUS BOREHOLE TELEMETRY SYSTEM AND METHOD

[75] Inventors: Joshua M. Jackson; Vernon E. Koval, both of Houston, Tex.

[73] Assignee: NL Sperry Sun, Inc., Houston, Tex.

[21] Appl. No.: 255,024

[22] Filed: Apr. 17, 1981

[51] Int. Cl.[3] ..... E21B 7/04; E21B 17/00; E21B 47/022

[52] U.S. Cl. ..... 175/45; 166/65 R; 175/62; 175/320

[58] Field of Search ..... 175/45, 40, 50, 61, 175/62, 107, 171, 320; 277/102, 104, 105; 174/47, 99 R, 100; 339/15; 324/356, 369

[56] References Cited

U.S. PATENT DOCUMENTS

| | | | |
|---|---|---|---|
| 3,224,513 | 12/1965 | Weeden, Jr. | 175/45 X |
| 3,878,903 | 4/1975 | Cherrington | 175/45 |
| 3,913,688 | 10/1975 | Heilhecker et al. | 175/320 |
| 3,926,269 | 12/1975 | Cullen et al. | 166/65 R X |
| 4,062,551 | 12/1977 | Base | 166/65 R X |
| 4,153,120 | 5/1979 | Zuvela et al. | 175/62 X |
| 4,200,297 | 4/1980 | Tricon | 166/65 R X |
| 4,275,786 | 6/1981 | Lee | 166/65 R |
| 4,317,493 | 3/1982 | Thompson | 175/45 |

*Primary Examiner*—Stephen J. Novosad
*Attorney, Agent, or Firm*—J. Holder; D. L. Traut

[57] ABSTRACT

In situations where it is necessary to directionally drill boreholes from the surface in a substantially horizontal attitude, such as for pipeline river crossings, the precise directional parameters of drilling become critical. A system of tools for efficiently accommodating the precise directional steering of the drilling includes a continuous electrical communications path within a drill string, which path provides steering data at the surface for controlling the drilling operation. A side entry sub is positioned in the tool string at its upper end. A cable system is employed in each pipe section placed in the string and includes provisions for breaking and making connections with the cable without withdrawing the cable from the pipe string. A steering tool is fixedly positioned in the drill pipe near the drill bit and is not normally withdrawn from the hole except with the drill bit.

22 Claims, 5 Drawing Figures

FIG. 3
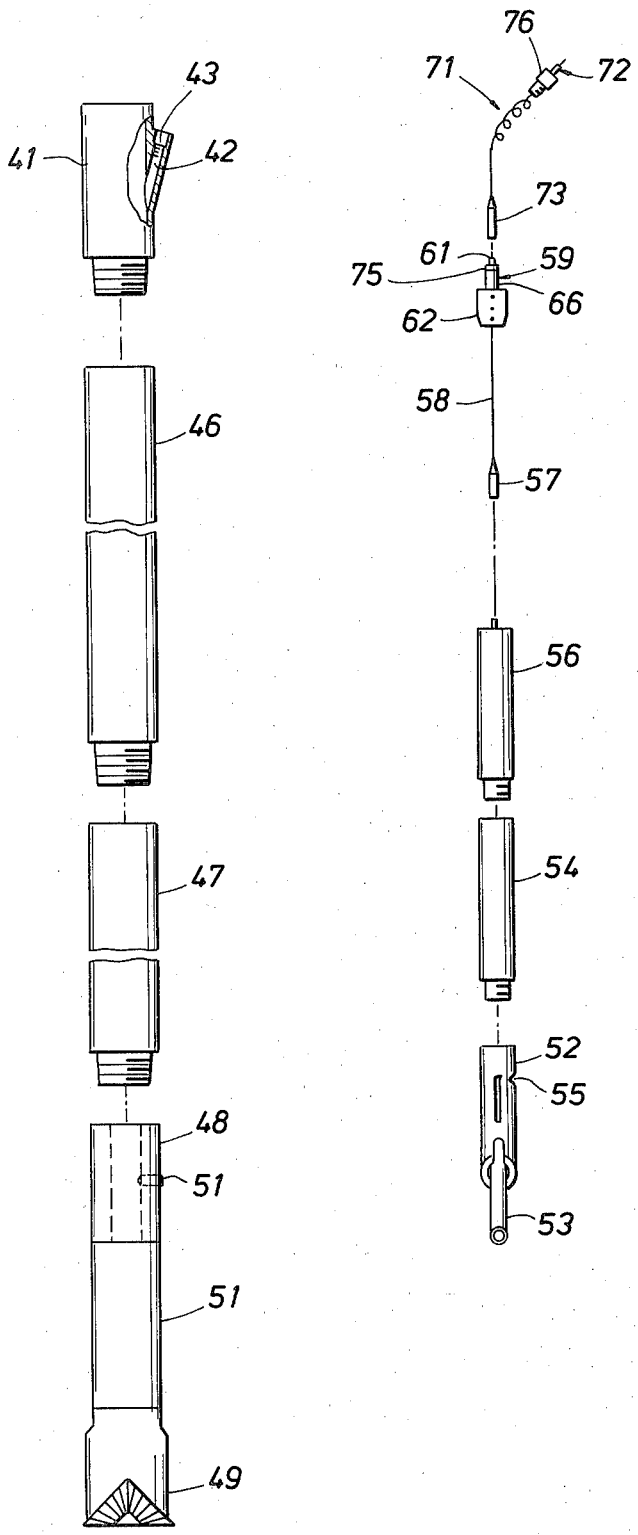
FIG. 4
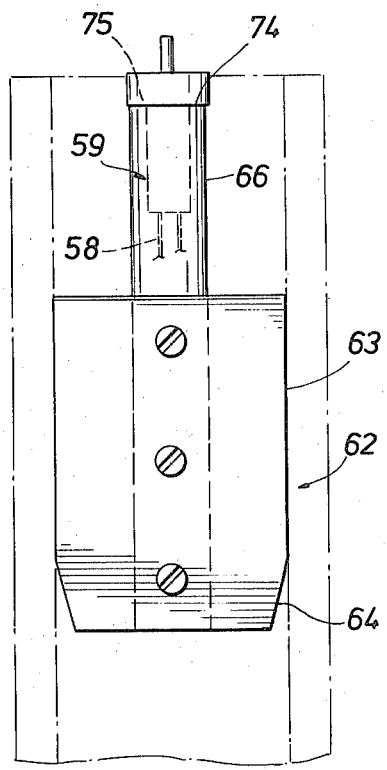
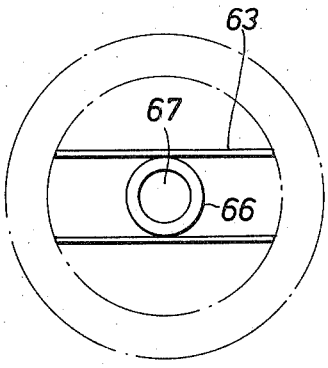
FIG. 5

CONTINUOUS BOREHOLE TELEMETRY SYSTEM AND METHOD

BACKGROUND OF THE INVENTION

This invention relates to a borehole surveying system and more particularly to a method and apparatus for continuously surveying a borehole drilled substantially horizontally throughout its length.

Drilling holes directionally and using surveying tools to provide directional information for such drilling has become a well-developed art. For the most part, however, this work has been in conjunction with conventionally drilled oil and gas wells with the critical directional aspects being associated with a particular phase of the drilling such as the beginning or end of the drilling operation. An example of this work has been the extensive use of directionally drilled holes in offshore operations. In recent years, a new technology has begun to develop around a method of drilling holes under rivers or the like to facilitate the passage of pipelines. River crossings have historically been a weak link in the construction of cross-country pipelines. Before the use of underground river crossings for pipelines, the two traditional methods were using bridges and laying pipe in dredged channels. There are several problems associated with these prior techniques, namely, interruption of navigation, danger to marine life, time consuming application for permits, costly river bank restoration and continuing river bank maintenance. Now, with the directionally-controlled horizontal drilling process, pipelines are run deep enough below river beds so that future erosion or scouring cannot expose them to the elements nor will dredging equipment or the like disturb them. During installation, river traffic on navigable streams and rivers is not disrupted. Since very little earth is moved (only that which is actually drilled from the hole), riverbeds and banks are left unaltered. Drilled crossings can also be made in highly congested areas utilizing existing corridors. River crossing systems as described above are shown in U.S. Pat. Nos. 3,878,903; 3,894,402; 4,003,440; 4,051,911 and 4,078,617. These operations are conducted using a custom built drilling rig which can drill up to 30 degrees from the horizontal along a predetermined profile under waterways or other obstructions to a targeted surface area on the opposite side of the riverbank or other obstruction. Safety and maintenance is greatly improved with the use of underground river crossings over prior techniques. Statistics show that pipeline river crossing failure due to natural or other causes, occurs approximately 30 times more frequently than failure in the cross-country portion of a pipeline. River dredging and cutting the banks for approaches can result in major earth moving operations. Erosion of the riverbed or recession of the river's bank can result in the exposure and failure of buried pipeline. Drilled crossings do not disturb the river or river bottom and in the case of waterways which are deepened and widened, placing the pipelines 25' to 100' under the existing bottom ensures the safety of the pipeline beyond any normal amount of exposure from natural or man-made activities.

Pipe laying has always presented special environmental problems. Returning the environment to its original state, once disturbed, has become a significant cost factor when designing and constructing a pipeline water crossing. Conservationists have justifiably caused pipeliners to take every consideration in mind when proposing a pipeline project. The drilling of pipeline water crossings eliminates the majority of concerns about these problems, thus making a significant difference in the time needed to secure the permits required to start a project. Because of the minimal effect drilled pipeline crossings have on the environment, fewer permits are required and are generally easier to obtain.

Thus directionally drilled water crossings provide the following advantages: (a) not being subject to damage from erosion and dredging operations, (b) construction schedules not subject to waterway conditions such as rising water, (c) permits are easier and faster to obtain because of lessened environmental impact, (d) waterway traffic is not exposed to navigational hazards or interruptions, (e) the cost of moving vast amounts of earth is eliminated as well as restoration costs of banks and future maintenance, (f) drilled river crossings are virtually maintenance free, thus eliminating a large expense in pipeline maintenance, and (g) drilling can be done in congested corridors and near existing pipelines.

The success of drilled river crossings has led to an enlarged concept for the use of drilled pipeline passages. For example, pipelines constructed from offshore areas often encounter physical barriers or obstacles as they come ashore. Obstacles encountered include the difficulties to construct through heavy surf or unstable shore areas, such as unstable slope or scour conditions, environmental or recreational restrictions, construction difficulties from steep bluffs, man-made obstructions such as roadways and canals, and congested industrial or commercial areas making above ground right-of-way difficult to obtain and hazardous. These considerations are set forth in detail in a technical paper, Number OTC 3786, entitled "Overcoming Obstacles in Landing Pipelines" by Hugh W. O'Donnel and presented at the Offshore Technology Conference in Houston, Tex., May 5–8, 1980.

In the past, guidance of the above described drilling technique has been accomplished using a bent sub in the drill string and periodically running a single shot directional recording instrument together with other conventional surveying tools to intermittently determine the course of the hole being drilled. Because of the nature of this operation, a fairly steady path need be drilled, i.e., without dog legs to permit the easy running in of pipe into the hole. (See prior art patents listed above for details of this technique.) This need for precise directional control requires the frequent running of single shot recording surveys, thus presenting a time-consuming and costly procedure. It is therefore an object of the present invention to provide a new and improved method and apparatus for continuously conducting controlled directional drilling of substantially horizontal boreholes.

SUMMARY OF THE INVENTION

With this and other objects in view, the present invention contemplates a continuously controlled survey system for use in a drill pipe string utilizing a bit and motor for operating the bit. A directional survey instrument is fixedly secured to and oriented with the pipe string. A conductor cable is passed through a side entry sub near the upper end of the pipe and thence downwardly through the pipe string to the survey instrument. The conductor cable is made up of discrete sections which are slightly larger than the section of pipe in which they are installed and have connectors at each end for making up with adjacent pipe sections in the pipe string. The conductor cable sections are maintained in the pipe sections by means of hangers which have a tubular sleeve in which a cable connector is seated.

Another aspect of the invention includes a coiled cable portion on that cable section that passes through the side entry sub and also having connectors at each end thereof. One of the connector ends is seated in a wall passage which communicates the exterior and interior of the pipe string.

In the method for operating the continuously controlled survey system, the tool string is made up by fixedly securing the survey instrument in the pipe string near the drill bit and placing sections of pipe thereabove which contain conductor cable. Hangers are installed in the upper end of each pipe section. The cable is then positioned in the hangers and has ample length to be extended beyond both ends of a pipe section. Connectors on each end of the discrete conductors are made up prior to joining the pipe sections and then the pipe is rotated to make up the treaded portions at each end thereof. The excess length of the conductors permits such rotation without twisting the conductor cable beyond its endurance. The upper end of the cable assembly passes through the side entry sub to the exterior of the pipe string for electrical connection with surface monitoring equipment. The coiled portion on the cable section passing through the side entry sub permits connector makeup and rotation between the pipe string and the sub without damaging or breaking the cable.

DETAILED DESCRIPTION OF THE DRAWINGS

FIG. 3 is a schematic elevational view of a pipe string and associated tool string;

FIG. 4 is a side elevation view of a conductor hanger for insertion in the upper end of a pipe section in accordance with the present invention; and FIG. 5 is a plan view of the hanger shown in FIG. 4.

DESCRIPTION OF THE PREFERRED EMBODIMENTS

Figure 1:
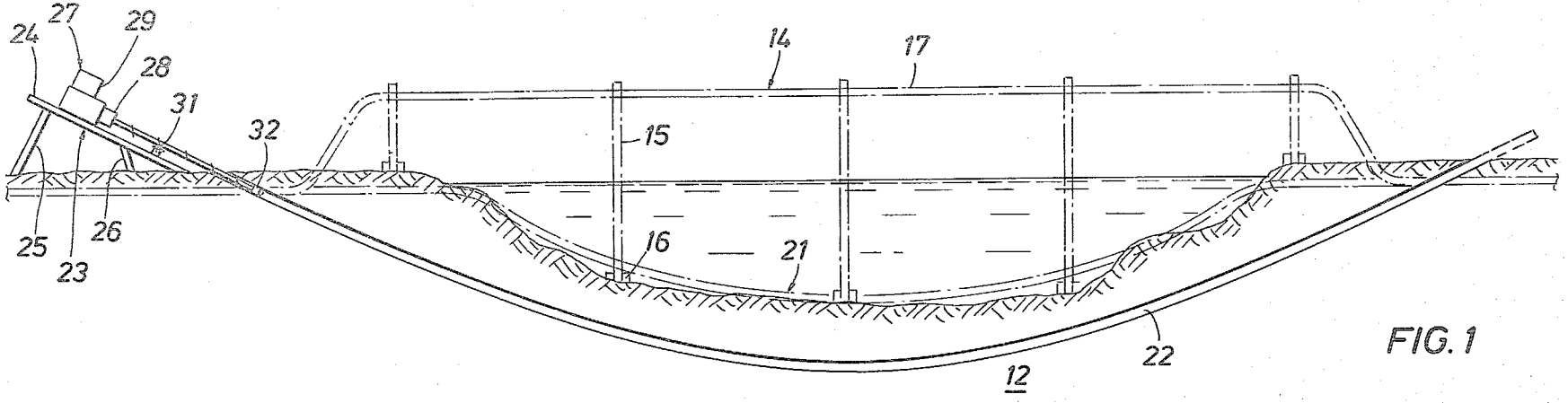
FIG. 1 shows a schematic illustration of a drilled pipeline river crossing system in comparison with prior techniques of pipeline river crossings.

Referring first to FIG. 1 of the drawings, the use of a directionally drilled hole for river crossings of pipeline is illustrated in comparison to prior conventional river crossing techniques. A river bed 12 is shown in cross section with three different pipeline river crossing systems. A bridged pipeline 14 is supported on piles 15 which are anchored in the river bed by means of foundation structures 16. The pipeline 17 is then suspended from the piles 15. It is readily seen that the construction of such a structure presents many problems such as anchoring supporting members under water and the heretofore mentioned environmental problems. Additionally navigation of the river or stream can be disrupted in the construction phase of such a crossing as well as by the permanent overhead structure of the crossing.

A dredged crossing such as shown as 21 requires the removal of vast amounts of earth from the riverbed and adjacent river banks. The ecological disadvantages of this system are readily apparent. Maintenance of such a crossing is extremely difficult due to a number of factors such as the shifting river bed and interference from river traffic and dredging operations.

The directionally drilled river crossing illustrated as 22 provides a system which virtually eliminates all the disadvantages of previous systems and offers a far superior method of accomplishing this task. The over 60 crossings completed at this data have unequivocally proven the superiority of the latter system. Since the inception of this system in 1971, installations to date cummulatively totaled 15 miles of pipe installed, with the longest installation having been 4,240 feet, and the largest a 40-inch pipe.

The drilling rig being used for under river crossings is a ramp style rig shown schematically at 23 which is composed of two sections mounted on tandem axles for mobility from one location to another. When assembled, the ramp is 80 feet long and serves the same purpose as a derrick on a standard vertical rig. The ramp structure 24 may be elevated at one end by means of a pivoting leg system 25 and 26 to raise the ramp to an angle of from 5 to 30 degrees from the horizontal.

An operators carriage moves up and down the ramp 24 and includes a rotary table 28, a control cab 29 and other elements not shown such as a pinion drive, wireline winch and hose reel. The rotary table is driven by hydraulic motors. A mud pumping system is skid mounted adjacent the ramp and utilizes triplex plunger pumps to operate the mud system. Support stands 31 are movably mounted on the ramp to support drill pipe in its near horizontal position on the ramp. The inclined carriage has a travel of 70 feet enabling it to handle pipe joints up to 60 feet long. When a joint of pipe is installed, the carriage advances as hole is made in the earth until the pipe length is drilled into the earth whereupon the upper end of the drill pipe is disconnected from the carriage, the carriage is retracted up the ramp and the next joint of pipe is added to the pipe string and drilling is continued. Such drilling is accomplished by means of a mud driven motor such as a Dynadrill and bit 32 at the lower end of the drill string. The mud system functions as on a conventional drilling rig. The mud is pumped down the drill pipe to drive the downhole mud motor and provides jetting action at the bit on the pilot hole. In addition, mud lubricates the hole and acts as a medium to carry cuttings out of the hole as it recirculates to the surface. After the pilot hole is drilled, a larger pipe is washed in over the pilot hole to accommodate the larger diameter of pipeline.

Figure 2:
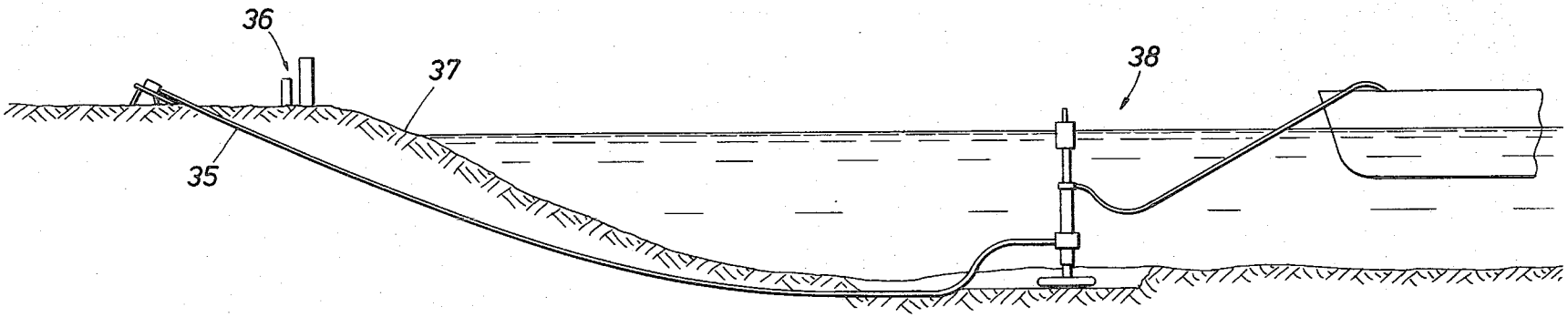
FIG. 2 shows a conceptual illustration of a directionally drilled pipeline landing from an offshore facility.

FIG. 2 of the drawings is a conceptual illustration of a pipeline landing from an offshore installation. A directionally drilled marine pipeline crossing is shown at 35 passing under shoreline obstacles such as buildings 36 and beach face 37. The pipeline 35 terminates in an offshore tanker unloading facility 38. This application will no doubt favorably utilize the technique heretofore developed for river crossings since it avoids almost all the problems associated with such a facility.

Next referring to FIG. 3 of the drawings, the drill string and associated tool string are shown for operating a continuous downhole guidance system in the drill string in accordance with the present invention. The upper end of the drill string for connecting with the carriage 27 and rotary table 28 is comprised of a feed-through or side entry sub 41. Sub 41 has standard pipe connections, such as box and pin ends, for making it up in a string of pipe. An oblique passage 42 is provided in the wall of the pipe sub 41 to permit wireline or cable communication between the exterior and interior of the pipe string. A shoulder 43 is formed on the outer end of the passage 42 and is arranged to receive and seat an electrical connector in the tool string. The passage 42 is threaded in its interior bore to secure the connector therein.

Shown positioned below the side entry sub is a section of drill pipe 46 having standard pipe joints for connection in a pipe string. As hole is drilled in the present method, additional sections of pipe 46 are added to the pipe string. At the lower end of the string of regular sections of pipe 46, one or more sections of non-magnetic drill collars 47 are placed in the string to house and thereby accommodate the use of guidance instruments which are sensitive to magnetic forces and thus need be shielded from the magnetic influence of surrounding steel pipe and equipment. A muleshoe sub 48 is positioned in the string below the non-magnetic collars housing the steering instrument. The muleshoe sub is oriented in the string in a predetermined manner with a bent sub (now shown) therebelow. The muleshoe sub has a cammed seating surface for aligning the steering instrument relative to the sub 48 and to the related bent sub. For this alignment technique, reference may be had to U.S. Pat. No. 3,718,194. A drill bit 49 and mud motor 51 are placed at the bottom of the drill string.

The right side of FIG. 3 shows the tool string in relation to its position in the drill string just described. The tool string has a muleshoe 52 at its lower end and includes a stinger 53 extending downwardly therefrom which aligns the muleshoe and the tool string to which it is attached, with the muleshoe sub 48. In normal usage of a steering tool, the tool string is intermittently lowered into the pipe string for use in orienting the hole and then subsequently retrieved from the hole. Thus the muleshoe alignment system offers a means to accomplish the precise alignment necessary for the landing and seating of a steering instrument. However, in the present application, the muleshoe 52 is preassembled in the muleshoe sub 48 and locked therein by means of set screws 51 which extend through an opening in the wall of the sub 48 and into mating indentions 55 on the side of the muleshoe. These set screws 51 serve to hold the muleshoe in a fixed position relative to the sub 48 and thus to the bit, which maintains a fixed orientation, for directional steering purposes, between the steering instrument and the drill bit. This method of orientation is also set forth in detail in U.S. Pat. No. 3,718,194. The set screw 51 also serves to maintain an electrical ground path between the tool string and the drill string so that the drill string acts as a conductor for ground potential.

One or more extension bars 54 are positioned above the muleshoe 52 to provide spacing between the steering tool probe 56 and magnetic portions of the drill string such as the motor and bit. The steering tool 56 is housed in the non-magnetic collar 47 to avoid the effects of steel drill pipe. The steering tool and its operation are likewise described in detail in U.S. Pat. No. 3,718,194.

Normally, the steering tool is lowered into a drill string on a wireline cable when it is desired to change the angle of a hole or during intensive directional drilling operations. The tool is usually suspended by a cable head on the cable. In the present tool string, the cable head is replaced by a female connector 57 attached to the lower end of a rubber coated cable section 58. The connector 57 attaches to a crossover sub (not shown) which serves to electrically mate the connector 57 with the steering tool probe 56. The upper end of cable section 58 is provided with a male connector 59 including an upwardly projecting pin connector 61. The male connector 59 is sized to be received and seat within a longitudinal sleeve 66 positioned in a hanger 62 (see FIGS. 4 and 5). Referring to FIGS. 4 and 5, the hanger 62 has a pair of gripping plates 63 having beveled bottom edge portions 64. The plates 63 are mounted in parallel planes on opposite sides of a tubular sleeve 66. The sleeve has a longitudinal bore 67 for receiving the male connector 59 in seating engagement.

Continuing upwardly in the tool string, a short coiled cable section 71, has upper and lower male and female connectors 72 and 73 respectively for completing the electrical circuit path from the steering tool to the surface package of the steering tool.

In the assembly and operation of the apparatus described above, the hanger 62 is arranged so that it can be force fit into the box end of a section of drill pipe. The beveled surface 64 on the hanger gripping plates 63 permits entry of the hanger into the drill pipe bore. As the hanger is forced downwardly into the pipe bore, the plates 63 bend transversely to the longitudinal axes of the pipe and thus decrease in their radial dimension. The spring action of the bowed plates 63 holds the hanger in place in the pipe bore. After assembly of the hanger 62 in the pipe 46, the cable section 58 is passed, female connector end first, through the bore 67 in cylindrical sleeve 66 until the male connector 59 at the top end of the cable section is seated in the hanger sleeve 66. The hanger sleeve 66 and connector 59 are sized to hold the connector therein. An annular shoulder 75 is formed on the upper end of connector 59 and is arranged to engage an upper end surface 74 of the sleeve 66 to prevent the connector from passing downwardly through the hanger 62. The connector 59 and sleeve bore 67 may also be cooperatively threaded to provide a threaded connection therebetween. The cable section 58 which is preassembled in the pipe section 46 and suspended therein by means of the hanger 62 and connector 59 seated therein, is made to be somewhat longer than the pipe section and on the order of one or two feet longer. The cables are made slightly longer than the drill pipe so that the female connector 57 at the bottom end of cable 58 can be manually extended down into the next pipe section below and pushed onto the male pin 61 extending upwardly from the connector 59 in the box end of the next succeeding drill pipe. When the pipe joints on adjoining pipe sections are rotated to make up the pipe connections, the extra length of cable permits the pipe connection without excessive twisting fatigue on the cables. Excess cable length is pushed into the lower pin end of pipe section 46 after the connectors are mated and before the pipe joint is made up.

In starting a hole using this system, the lower end of the pipe and tool string are made up in the manner described, with a section of drill pipe 46 at its upper end. The coiled cable 71 is passed through the passage 42 in side entry sub 41, female connector end first. The male connector has a threaded portion for engagement with mating female threads in the passage 42. An annular flange 76 on the male connector engages the shoulder 43 in the passage 42 to seat the connector therein. Means (now shown) are made for providing a ground connection between plug 72 and the sub 41 or between a tandem plug and the sub. This completes the electrical path in the system, using the pipe string as the ground path. The side entry sub is then made up on the upper end of the top pipe section, with the coil accommodating the relative turning motion of the sub 41 and pipe 46 to prevent excessive twisting of the cable 71.

When the drilling has progressed to the extent that the carriage 27 is near the bottom of ramp 24, the pipe string below the side entry sub 41 is unthreaded, the carriage is retracted up the ramp, and another section of pipe 46 is made up in the string as described above.

The above system permits the steering tool to be operated continuously throughout the drilling operation of the pilot hole and thus precisely control the direction of the hole. At the same time, costly downtime previously associated with stopping the drilling operation and making single shot directional surveys is avoided.

While particular embodiments of the present invention have been shown and described, it is apparent that changes and modifications may be made without departing from this invention in its broader aspects. For example, while this invention has been described for use with horizontal drilling of pipeline river crossings, it is apparent that other types and configurations of boreholes could be drilled with this system. Therefore, it is the aim in the appended claims to cover all such changes and modifications that fall within the true spirit and scope of this invention.

What is claimed is:

1. A borehole survey system for use in a drill string drilling substantially horizontal boreholes, comprising:

a pipe string having a drill bit at its lower end;

motive means for operating the drill bit in the pipe string;

instrument means positioned in the pipe string near the drill bit for providing directional information to permit steering of the drill bit;

side entry means near the upper end of the pipe string for permitting passage of an electrical cable from the exterior to the interior of the pipe string;

hanger means positioned within each section of pipe making up the pipe string; and electrical conductor means positioned in each section of pipe and having a portion thereof arranged for seating in said hanger means;

said electrical conductor means are longer than the section of pipe in which they are positioned and further including connector means on each end of said conductor means.

2. The apparatus of claim 1 and further including an electrical cable for passage through said side entry means, said electrical cable having a coiled portion.

3. The apparatus of claim 2 wherein said coiled portion terminates in an electrical connector and further including another electrical connector at the other end of said electrical cable.

4. The apparatus of claim 3 wherein said another electrical connector at the other end of said cable is arranged to be positioned in said side entry means so that said another electrical connector is accessible from the exterior of the pipe string when said side entry means is assembled in said pipe string.

5. The apparatus of claim 1 and further including connector means terminating each end of said electrical conductor means.

6. The apparatus of claim 1 wherein one of said connector means is seated in said hanger means.

7. The apparatus of claim 1 wherein said hanger means is comprised of a tubular sleeve open at both ends and axially arranged within the center of the section of pipe, and further includes means for maintaining said tubular sleeve centrally positioned within the pipe while permitting fluid circulation thereabout.

8. The apparatus of claim 7 wherein said portion of said electrical conductor means arranged for seating in said hanger is comprised of a connector sized to fit within said tubular sleeve.

9. The apparatus of claim 1 wherein said instrument means includes a muleshoe orienting sub attached to the pipe and oriented with respect to the bit, a muleshoe attached to a directional parameter measuring instrument, and wherein said muleshoe sub and muleshoe are immovably fixed to one another.

10. The apparatus of claim 1 wherein said electrical conductor means forms one electrical path between the upper end of the pipe string and the instrument means, with another electrical path being provided by said pipe string itself.

11. A method for directionally surveying a substantially horizontal borehole being drilled under the earth's surface, wherein such borehole is drilled by means of a bit rotated on the end of a pipe string, comprising:

positioning a directional survey tool in the pipe string near the drill bit;

positioning lengths of electrical conductor in each drill pipe section to be added to the pipe string, with such conductor lengths being longer than the pipe sections and having connector portions accessible at the top and bottom of the pipe sections;

connecting adjacent lengths of conductor in adjoining pipe sections before connecting such adjoining pipe sections;

positioning such sections of pipe in the pipe string above the survey tool and connecting the connector at the bottom of conductor in the bottom pipe section to the survey tool;

connecting a side entry pipe at the top of the pipe string;

passing a side entry conductor through the side entry pipe to provide an electrical conductor path from the exterior to the interior of the pipe string; and electrically connecting the bottom end of the side entry conductor to the conductor connection portion accessible at the top of the uppermost pipe section.

12. The method of claim 11 and further including as the drilling progresses, adding subsequent sections of pipe to the pipe string between the side entry pipe and the uppermost pipe section; and making up such connector portions between adjacent conductor lengths in the pipe sections before joining the pipe sections.

13. The method of claim 11 and further including passing a coiled side entry conductor through the side entry pipe.

14. The method of claim 11 and further including positioning the directional survey tool in a muleshoe sub in the pipe string, such muleshoe sub being fixedly oriented with respect to the drill bit.

15. The method of claim 14 and further including fixedly coupling such directional survey tool within such muleshoe sub.

16. The method of claim 11 and further including positioning a centrally disposed hanger within each section of pipe at its upper end, and passing such lengths of electrical conductor through such hanger and seating a portion of the conductor therein.

17. The method of claim 11 and further including using the length of conductor exceeding the pipe section length to make up conductor connections between sections of pipe and tucking the excess conductor length into the ends of the pipe sections before joining the pipe sections.

18. In a system for controlling a substantially horizontally directionally drilled borehole and utilizing a pipe string having a drill bit at its lower end and motive means for operating the drill bit, together with a directional survey instrument positioned near the drill bit in the pipe string, means for operating the survey instrument continuously and providing directional data to the surface over a conductor cable, which means comprises;

a hanger positioned in the upper end of each section of pipe; and a tubular sleeve means in the center of said hanger and sized to receive the conductor cable therethrough;

said sleeve means being sized to receive a portion of the conductor cable in seating relationship; and said conductor cable is arranged in sections which are slightly longer than a section of pipe string and including connector portions on each end thereof.

19. The apparatus of claim 18 wherein said portion of conductor cable received in seating relationship to said tubular sleeve is one of said connector portions.

20. The apparatus of claim 18 wherein said hanger includes parallel spring plates mounted on opposite sides of said sleeve and arranged to deform when forced into the upper end of a section of pipe, such deformation serving as a spring force to hold the hanger in place in the pipe section.

21. The apparatus of claim 20 and further including a beveled edge portion on the bottom edge of said spring plates to guide said spring plates into the upper end of the section of pipe.

22. In a system for continuously directing the drilling of a substantially horizontal directional borehole and utilizing a pipe string having a drill bit and associated motive means at the lower end of the pipe string, together with a continuously operable directional survey instrument positioned in the pipe string near the drill bit, means for operating the survey instrument to continuously provide steering data to the surface over an electrical cable, which means comprises;

a side entry pipe section positioned near the upper end of the pipe string;

passage means extending through the wall of said side entry pipe section and opening to the interior and the exterior of the side entry pipe section;

cable conductor means for passage through said side entry pipe and passage means, said cable conductor means having a connection at each end thereof; and shoulder means arranged in the exterior opening of the passage means, said shoulder means having a threaded portion for threadedly receiving one of said connectors, said conductor cable means is arranged in sections which are slightly longer than a section of said pipe string.

* * * * *